US005465515A

United States Patent [19]

Walieddine

[11] Patent Number: 5,465,515

[45] Date of Patent: Nov. 14, 1995

[54] MODULAR ADVERTISING DISPLAY APPARATUS

[76] Inventor: Fadi S. Walieddine, 10600 Wilkins Ave., #A2, Los Angeles, Calif. 90024

[21] Appl. No.: 142,944

[22] Filed: Sep. 29, 1993

[51] Int. Cl.[6] ..... G09F 11/18

[52] U.S. Cl. ..... 40/471; 40/518

[58] Field of Search ..... 40/471, 518, 467, 40/466, 472, 519, 520, 521, 522, 523

[56] References Cited

U.S. PATENT DOCUMENTS

| | | | |
|---|---|---|---|
| 3,426,461 | 2/1969 | Miller | 40/471 |
| 3,510,973 | 5/1970 | Mazzocco, Sr. | 40/471 |
| 3,616,554 | 11/1971 | Singer et al. | 40/471 |

FOREIGN PATENT DOCUMENTS

| | | | |
|---|---|---|---|
| 2448203 | 10/1980 | France | 40/471 |
| 3624123 | 1/1988 | Germany | 40/518 |
| 27256 | of 1903 | United Kingdom | 40/467 |

*Primary Examiner*—Brian K. Green
*Attorney, Agent, or Firm*—Michael A. Painter

[57] ABSTRACT

An illuminated advertising media display assembly comprising an elongated group of viewing modules through which to display advertising indicia. An elongated, translucent banner is adapted to be horizontally scrolled between a pair of drive rollers. The banner includes a plurality of receiving enclosures adapted to compactly store translucent advertising media. Each module is bounded by a pair of idler rollers for orienting the banner and advertising media into position with respect to the viewing aperture. A pair of modules are pivotable with respect to the supporting assembly to provide access to the interior of the enclosure formed by the modules and for changing the visual orientation of a viewing aperture relative to an adjacent module. When the drive rollers are rotated, the banner will be dynamically scrolled from one to the other, each advertisement being sequentially visible at the adjacent viewing apertures.

7 Claims, 2 Drawing Sheets

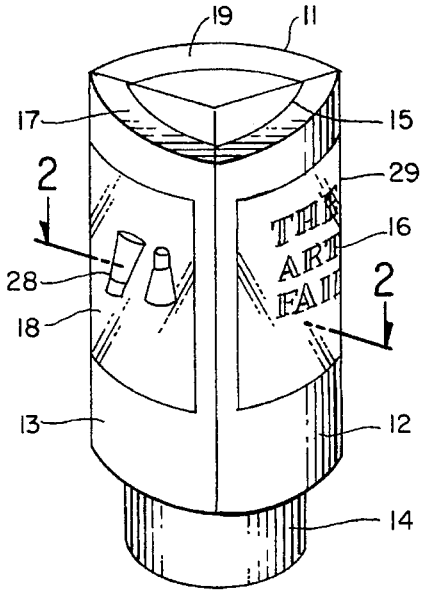
FIG. 1.
FIG. 2.
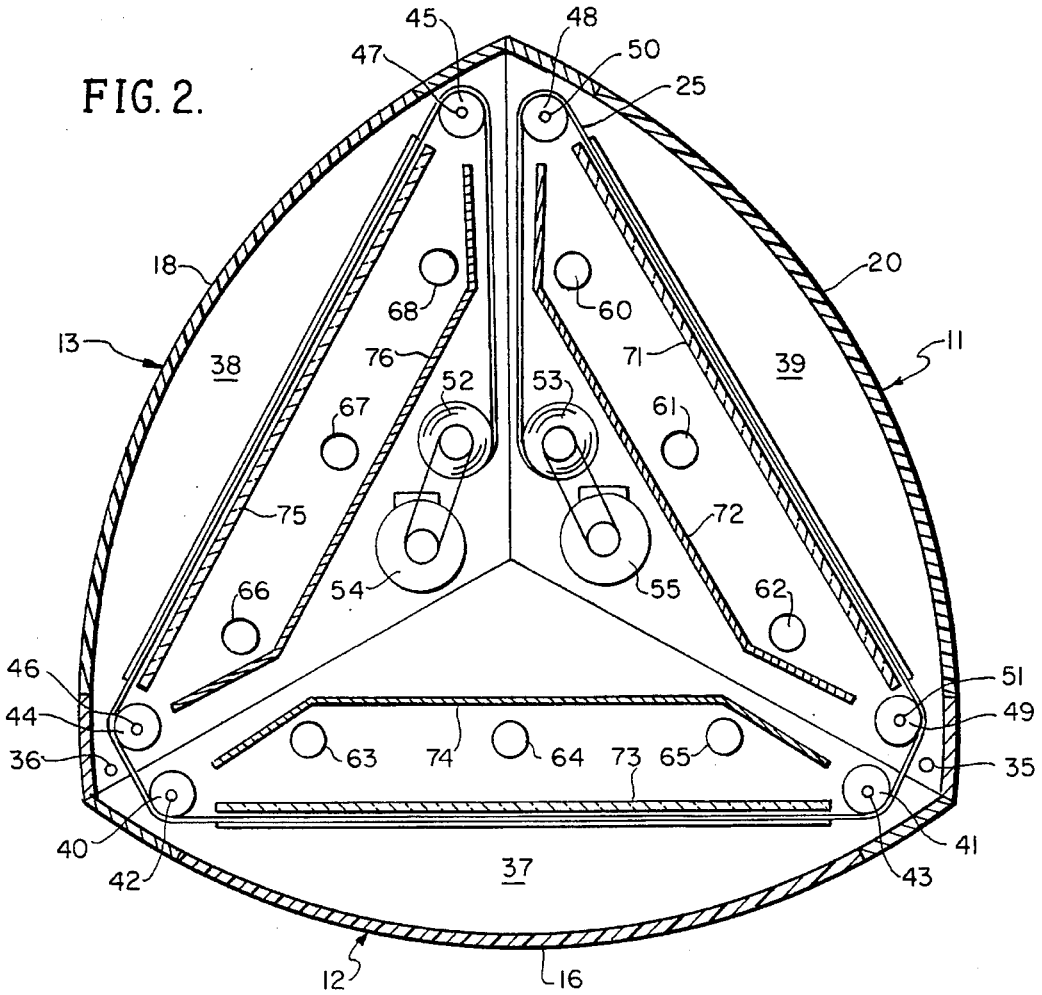

FIG. 3.
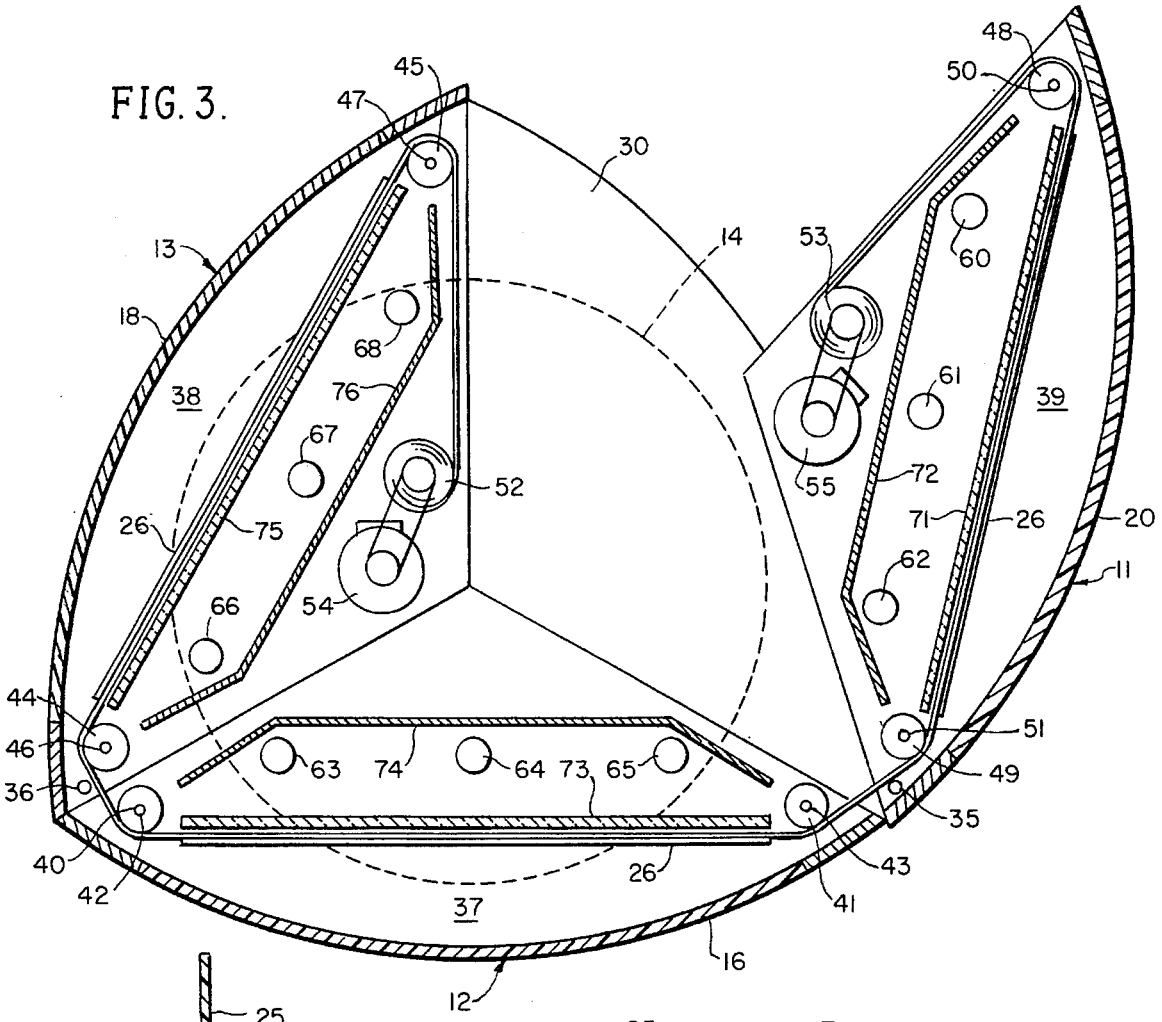
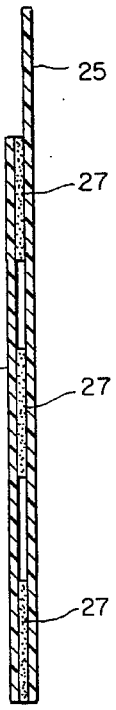
FIG. 5.
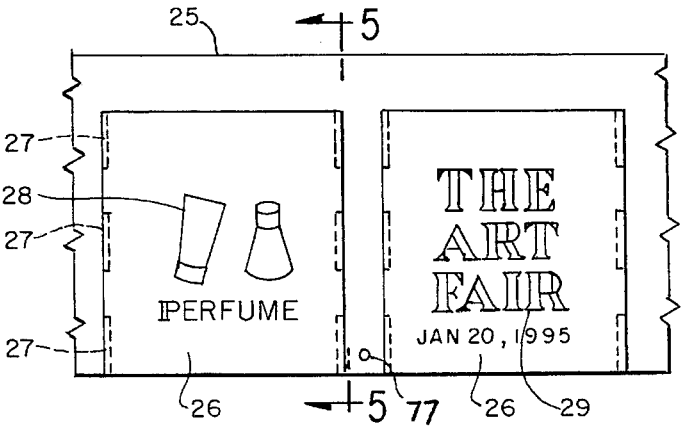
FIG. 4.

MODULAR ADVERTISING DISPLAY APPARATUS

BACKGROUND OF THE INVENTION

1. Field of the Invention

The present invention generally relates to advertising display apparatus and more particularly to modular display apparatus adapted to sequentially display advertising indicia at multiple viewing locations.

2. Prior Art

With increasing value being placed upon the public exposure of advertising media, a need has arisen for providing means to display advertising media in a more efficient manner. This need is particularly evident in locations where a large audience is available to be exposed to advertising over an extended period of time (e.g., sporting events, restaurants, theaters). The conventional means of advertising used a fixed display which may not be altered or changed in a short period of time. As a result, the viewing audience will be exposed to a limited amount of advertising thereby substantially increasing advertising costs.

A device taught by the prior art transports a plurality of advertisements between a pair of reels which may alternatively serve as a take-up or supply reel, the option being dependent upon the direction of motive power. The device taught by the prior art utilizes only a single viewing window. The problems which are inherent in this device are obvious. Although a transported series of advertisements may be sequentially displayed, the use of only a single viewing window limits the directional orientation and thereby substantially reduces the available viewing audience.

The present invention substantially resolves those problems inherent in the devices taught by the prior art through the use of a plurality of viewing modules assembled in a polygon. A plurality of modular viewing apertures or windows are employed, each viewing window being bounded by a set of vertically oriented idler rollers. A selected pair of modules are pivotable with respect to the remaining modules. Pivoting a module provides access to the interior of the display assembly and permits changes to the direction of orientation of the viewing window. A horizontally transportable banner supports advertising media. The ends of the banner are secured to rotatable reels or drive rollers which are powered to alternatively allow the drive rollers to act as supply and take-up reels. Irrespective of the number of modules, the present invention employs only a single pair of drive rollers and rotational power sources therefor. The banner is extended across each of the idler rollers associated with the plurality of modules. The banner and advertising media are translucent. By appropriate illumination or backlighting, each piece of advertising media may be sequentially displayed at all viewing areas.

SUMMARY OF THE INVENTION

The present invention modular advertising display apparatus is adapted to sequentially display horizontally mounted advertising indicia at a plurality of viewing areas. Each module comprises a viewing window through which advertising indicia may be seen. The modules are assembled in a closed polygon, the viewing windows of the assembled module being directed outwardly. Vertically oriented idler rollers are rotatably mounted on opposite sides of each viewing window. The assembled modules define an interior cavity within which illuminating sources are mounted. To gain access to the interior cavity or to change the direction of a viewing window, a pair of modules may be pivotally rotated about a vertical axis relative to the adjacent, intermediate module or modules.

Advertising indicia are secured or otherwise mounted upon a translucent, horizontally transportable banner. The media which is sought to be displayed is itself disposed on a translucent base. The ends of the banner are affixed to a respective pair of drive rollers. Each drive roller is rotatably powered by a suitable motive force such as an electric motor. Each drive roller may serve as a supply reel or a take-up reel depending upon the direction in which the drive rollers are rotated. Irrespective of the number of modules which make up the embodiment of the present invention, only a single pair of drive rollers and associated motors are employed.

The translucent banner and mounted translucent advertising media are positioned about the idler rollers associated with each module. When in operation, each individual advertisement will be unscrolled from the drive roller acting as the supply reel and be sequentially viewed through the viewing windows of adjacent modules. The advertising media will be stored upon the drive roller acting as a take-up reel and will be in position for reviewing upon changing the direction of movement of the banner supporting the advertising media.

It is therefore an object of the present invention to provide an improved advertising media display apparatus.

It is another object of the present invention to provide an advertising display apparatus having a plurality of independently viewable display windows.

It is still another object of the present invention to provide a modular advertising display apparatus employing a plurality of modules which may be positioned to a selected viewing orientation.

It is still yet another object of the present invention to provide an improved advertising media display apparatus which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 comprises a perspective view of a three module embodiment of e present invention.

FIG. 2 is a partial cross-sectional view of the form of the present invention shown in FIG. 1 taken through line 2—2 of FIG. 1.

FIG. 3 is a schematic, top plan view of a three module form of the present invention illustrating one module and viewing window repositioned relative to an adjacent module.

FIG. 4 illustrates a portion of the horizontally transportable banner and enclosing pockets for mounting advertising media.

FIG. 5 is a cross-sectional view of the banner and enclosing pocket shown in FIG. 4 taken through line 5—5 of FIG. 4.

DESCRIPTION OF THE PRESENTLY PREFERRED EMBODIMENT

The present invention is an advertising display apparatus which is comprised of an assembly of modules, each one of which includes a viewing window which is spatially oriented in a direction determined by the number of modules. FIG. 1 illustrates a form of the present invention constructed with three modules 11, 12 and 13. Irrespective of the number of modules used, the assembly comprising the present invention is in the form of a polygon, the advertising displays being viewable from all directions. In the form of the present invention shown in FIG. 1, modules 11, 12 and 13 are separated by 120° of arc. It is understood the use of three modules is for the purpose of example only, the principle of the present invention being applicable to assemblies comprising more or less than three modules. As an example, if the present invention comprises an assembly of four modules, each would be separated from an adjacent module by 90° of arc.

The present invention may be best understood by reference to FIG. 1 and FIG. 2. In the form of the present invention shown in FIG. 1, modules 11, 12 and 13 are mounted upon a base 14. An objective of the present invention is to provide means wherein visual advertising indicia may be viewed from a variety of positions. As can be best seen in FIG. 1, the module 12 comprises a supporting frame 15 within which a translucent viewing window 16 is mounted and through which advertising indicia may be viewed. In a like manner, module 13 comprises a supporting frame 17 within which translucent viewing window 18 is mounted. In the three-module form of the present invention, module 11 is comprised of a supporting frame 19 within which translucent viewing window 20 is mounted.

The advertising indicia to be viewed through the use of the present invention is mounted upon an elongated, translucent banner 25 which can be best seen in FIG. 4 and FIG. 5. The banner 25 is constructed of a clear flexible material such as Mylar. A plurality of translucent pockets 26, typically fabricated of Mylar, are secured along the elongated length of banner 25. Each of the pockets 26 are adapted to receive a translucent panel upon which advertising indicia 28 and 29 are disposed. Although the number of pockets 26 which may be employed on banner 25 is a matter of choice, the preferred form of the present invention would use approximately 30 or more pockets within which to mount advertising media. As will be described in detail hereinbelow, banner 25 and the stored advertising media will be rolled upon and transported between a pair of drive rollers. To prevent the entrapment of air as banner 25 is scrolled upon a drive roller, pockets 26 are secured to banner 25 by multiple segments of adhesive 27 having gaps therebetween. As banner 25 is scrolled, the force imposed upon pockets 26 will cause entrapped air to egress through the gaps intermediate adhesive segments 27.

The organization of the present invention provides means to provide access to the interior cavity formed by the enclosed modules 11, 12 and 13 or to reorient viewing windows and thereby change the angle at which the advertising media may be viewed. Access to the interior cavity is required to permit maintenance and to allow the user to change the advertising media mounted within pockets 26.

In a three module embodiment of the present invention, module 11 is pivotally coupled to support base 30 (FIG. 3) at hinge 35. In a like manner, module 13 is pivotally coupled to support base 30 at hinge 36. Also shown in FIG. 1 and FIG. 3, support base 30 is mounted upon base . As will be described in detail hereinbelow, module 11 may be rotated clockwise relative to module 12 and module 13 may be rotated counterclockwise relative to module 12.

For the purpose of example, the present invention has been described by reference to a three-module assembly. It is understood the principle of the present invention is applicable to an assembly having a different number of modules grouped to form a polygon. If constructed of five modules, three of the modules would be adjacent and stationary, the end modules being placed at either end of the stationary modules and being pivotally coupled with respect to the stationary modules in the manner described with respect to FIG. 2 and FIG. 3.

In order to provide a path for transporting banner 25, each viewing window is bounded by a pair of idler rollers. With respect to viewing window 16 of module 12, idler rollers 40 and 41 are vertically mounted upon base member 37 on opposite sides of viewing window 16 and are suitably journeled to rotate about their axes 42 and 43, respectively. For module 13, idler rollers 44 and 45 are vertically mounted upon base member 38 on either side of viewing window 18 and are suitably journeled about their axes 46 and 47, respectively. In a like manner, for module 11, idler rollers 48 and 49 are vertically mounted upon base member 39 on either side of viewing window 20 and are suitably journeled to rotate about axes 50 and 51, respectively.

The ends of banner 25 are secured between a pair of drive rollers 52 and 53 which are rotatable in parallel spaced relation to idler rollers 40, 41, 44, 45, 48 and 49. Drive roller 52 is coupled to and powered by a conventional motor 54. In a like manner, drive roller 53 is coupled to and powered by a conventional motor 55. Drive rollers 52 and 53 may serve as either a supply reel or a take-up reel for banner 25 depending upon the direction of rotation of drive rollers 52 and 53. It is understood that motors 54 and 55 are bidirectional and may thereby transport banner 25 from drive roller 52 to drive roller 53 or from drive roller 53 to drive roller 52. As will be explained in detail hereinbelow, drive roller 52 and motor 54 are coupled to supporting base member 38 of module 13. In a like manner, drive roller 53 and associated motor 55 are coupled to base member 39 of module 11.

The present invention is adapted to display advertising indicia mounted upon a translucent substrate which in turn is mounted upon translucent banner 25. To display the advertising indicia, illuminating sources are mounted within the enclosure formed by modules 11, 12 and 13 on the opposite side of banner 25 from viewing windows 16, 18 and 20. As can be best seen in FIG. 2, illuminating sources 60, 61 and 62 are mounted upon base member 39 of module 11. Illuminating sources 63, 64 and 65 are mounted upon base member 37 of module 12. Illuminating sources 66, 67 and 68 are mounted upon base member 38 of module 13.

In order to insure uniform illumination of advertising media, each module 11, 12 and 13 includes a reflector for redirecting the light emanating from the illuminating sources and a light diffuser to uniformly disperse the light across the viewing windows 20, 16 and 18 of modules 11, 12 and 13, respectively. As can be best seen in FIG. 2, module 11 has secured thereto light diffuser 71 and reflector 72. Light diffuser 71 is mounted between banner 25 and the illuminating sources 60, 61 and 62. Reflector 72 is mounted to base member 39 on the opposing side of illuminating sources 60, 61, and 62. Light diffuser 73 and reflector 74 are mounted upon base member 37 of module 12. The orientation of light diffuser 73 and reflector 74 relative to banner 25 and illuminating sources 63, 64 and 65 is the same as described with respect to module 11. Light diffuser 75 and reflector 76 are mounted upon base member 38 of module 13. The orientation of light diffuser 75 and reflector 76 relative to banner 25 and illuminating sources 66, 67 and 68 is the same as that described with respect to module 11.

When the present invention is operated in the direction shown in FIG. 2, banner 25 will be unscrolled from drive roller 52 and be sequentially moved about idler rollers 45, 44, 40, 41, 49 and 48. Drive roller 53 will function as a take-up reel. As discussed hereinabove, individual forms of advertising indicia are secured within pockets 26. After being unscrolled from drive roller 52, each piece of advertising media will be sequentially viewable through translucent viewing windows 18, 16 and 20, respectively. Although banner 25 could be maintained in constant motion during use, a preferred form of the present invention permits motors 54 and 55 to be intermittently stopped for a selected interval of time to permit viewing of the advertising media in a fixed position. Intermittent operation may be achieved by disposing visually or magnetically detectable indices 77 on banner 25, the form of the detection member being one of choice.

An objective of the present invention is to provide access to the interior cavity formed by modules 11, 12 and 13 and to allow one the capability to change the position of a viewing window in order to change the direction from which advertising media may be seen. The manner in which this objective has been met may be best seen by reference to FIG. 3. Module 11 may be rotated clockwise relative to module 12 by rotating same about hinged coupling 35 between base member 39 and support base 30. Since illuminating sources 60, 61 and 62 and drive roller 51 and associated motor 55 are coupled to supporting base member 39 of module 11, rotation of module 11 will result in rotation of all mounted elements. Furthermore, since idler rollers 41 and 49 are journeled on to supporting base members 37 and 39, respectively, on opposite sides of hinge 35, the movement of banner 25 over idler rollers 41 and 49 will be uninterrupted. It is further understood that a form of the present invention that includes more than three modules will include a plurality of stationary modules represented by the structure of module 12 along with two adjacent pivotable modules which include drive rollers 52 and 53 and the associated motors 54 and 55, respectively. It is understood that module 13 will rotate counterclockwise about hinge 36 and therefore its relationship to module 12 is the same as that described with respect to module 11.

It can therefore be seen the present invention provides an improved modular apparatus for displaying advertising media. A horizontally transportable banner 25 may be alternatively moved between a pair of drive rollers 52 and 53. All mounted advertising indicia will be alternatively viewable through viewing windows 16, 18 and 20. By allowing modules 11 and 13 to be pivoted with respect to the stationary modules (e.g., module 12), access is gained to the interior cavity which permits the user to maintain the equipment and to change the advertising media mounted upon banner 25. To increase the available viewing area, modules 11 and 13 may be repositioned to change the direction from which the respective viewing windows 18 and 20 may be seen.

I claim:

1. A modular advertising display apparatus comprising:

(a) a support base;

(b) a plurality of display modules being angularly displaced from one another, each comprising a supporting frame having a translucent viewing window therethrough and journeled idler rollers on either side of said viewing window, wherein at least one supporting frame of a display module includes a base member, a hinge secured to the support base, the base member being coupled to said hinge, whereby said display module is pivotally coupled relative to the supporting frame of an adjacent display module about said hinge;

(c) first and second drive rollers;

(d) an elongated translucent banner having first and second ends and including means for mounting advertising indicia thereto, said banner being secured to the first and second drive rollers and being in contact with each of said idler rollers;

(e) illuminating means for illuminating the advertising indicia coupled to each of the supporting frames of each plurality of display modules; and (f) first and second rotational means coupled to the first and second drive rollers for scrolling the elongated translucent banner between said first and second drive rollers.

2. A modular advertising display apparatus as defined in claim 1 wherein the angular displacement between viewing windows is uniform.

3. A modular advertising display apparatus as defined in claim 1 wherein said means for mounting advertising indicia comprises a plurality of translucent pockets mounted along the elongated translucent banner in uniform, spaced relation.

4. A modular advertising display apparatus as defined in claim 3 wherein said pockets are secured to the elongated translucent banner by spaced adhesive members.

5. A modular advertising display apparatus as defined in claim 1 wherein said each display module further includes a light diffusing member and a light reflecting member, said light diffusing member being disposed between the idler rollers and adapted to be intermediate the illuminating means and the elongated banner, said light reflecting member being positioned in opposition to the illuminating means from the light diffuser member.

6. A modular advertising display apparatus comprising:

(a) a display base;

(b) a plurality of display modules being angularly displaced from one another, each comprising a support frame having a translucent viewing window and a pair of idler rollers vertically journeled to the support frame on either side of the viewing window, said display modules forming a polygon defining an interior cavity therebetween with each of the viewing windows being directed outwardly, the angular displacement between adjacent viewing windows being uniform, at least one of said display modules having a base member, a hinge secured to the support base, the base member being coupled to said hinge whereby said display module is pivotally coupled relative to the support frame of an adjacent display module about said hinge;

(c) first and second drive rollers;

(d) an elongated translucent banner having first and second ends and including a plurality of translucent pockets coupled along the banner in uniform spaced relation each being adapted to receive advertising indicia, said banner being secured between the first and second drive rollers and being in contact with all of said idler rollers;

(e) a plurality of illuminating members coupled to the supporting frame of each of said display modules;

(f) a light diffusing member secured to the supporting frame of each of said display modules intermediate the idler rollers and adapted to be substantially adjacent the elongated translucent banner;

(g) a light reflecting member being secured to the supporting frame of each of said display modules on the opposite side of the illumination members from the light diffusing member; and (h) first and second bi-directional rotational means coupled to the first and second drive rollers for scrolling the elongated translucent banner between said first and second drive rollers.

7. A modular advertising display apparatus as defined in claim 6 wherein said pockets are secured to the elongated translucent banner by spaced adhesive members.

* * * * *